US012214239B1

(12) United States Patent
Yu et al.

(10) Patent No.: US 12,214,239 B1
(45) Date of Patent: Feb. 4, 2025

(54) DUMBBELL, BARBELL, AND KETTLEBELL

(71) Applicant: Yongkang Zuojian Industry and Trade Co., Ltd., Yongkang (CN)

(72) Inventors: Zhaohong Yu, Yongkang (CN); Xiaoqing Xu, Hangzhou (CN)

(73) Assignee: Yongkang Zuojian Industry and Trade Co., Ltd., Yongkang (CN)

( * ) Notice: Subject to any disclaimer, the term of this patent is extended or adjusted under 35 U.S.C. 154(b) by 0 days.

(21) Appl. No.: 18/582,843

(22) Filed: Feb. 21, 2024

(30) Foreign Application Priority Data

Jan. 26, 2024 (CN) ..... 202420202246.6

(51) Int. Cl.
*A63B 21/072* (2006.01)

(52) U.S. Cl.
CPC ..... *A63B 21/0728* (2013.01); *A63B 21/0726* (2013.01)

(58) Field of Classification Search
CPC . A63B 21/0728; A63B 21/0726; A63B 21/06; A63B 21/072–075
See application file for complete search history.

(56) References Cited

U.S. PATENT DOCUMENTS 6,500,101 B1 12/2002 Chen
6,656,093 B2 * 12/2003 Chen ..... A63B 21/063 482/107
7,811,213 B2 * 10/2010 Chen ..... A63B 21/0728 482/107
9,504,868 B2 * 11/2016 Liu ..... A63B 21/0726
2012/0309597 A1 * 12/2012 Liu ..... A63B 21/00065 482/107
2013/0324375 A1 * 12/2013 Svenberg ..... A63B 21/00069 482/108
2021/0146187 A1 * 5/2021 Chen ..... A63B 21/0726
2022/0152443 A1 * 5/2022 Casagrande ..... A63B 21/0728
2022/0193479 A1 * 6/2022 Wu ..... A63B 21/075
2022/0257993 A1 * 8/2022 Geng ..... A63B 21/0728
2023/0001258 A1 * 1/2023 Svenberg ..... A63B 21/075
2023/0264067 A1 * 8/2023 Wang ..... A63B 21/0726 482/107
2023/0347200 A1 * 11/2023 Casagrande ..... A63B 21/075

* cited by examiner

*Primary Examiner* — Joshua Lee
*Assistant Examiner* — Catrina A Letterman
(74) *Attorney, Agent, or Firm* — Birchwood IP

(57) ABSTRACT

The present disclosure provides a simple dumbbell including a dumbbell rod, an adjustment component, and a dumbbell piece. Two semicircular telescopic rods are provided in the dumbbell rod, a square groove is provided in a middle of the two semicircular telescopic rods. A square rod is provided on the square groove, a fix hole is respectively provided at two ends of the square rod. A limit tooth is provided on the semicircular telescopic rod; the adjustment component includes an adjustment arm and a locking component. A connection hole is provided in a middle of the adjustment arm, a connection component connecting to an installation seat is provided in the connection hole. An adjustment area is provided below the adjustment arm, the adjustment area cooperates with the locking component to adjust the semicircular telescopic rod; the dumbbell piece is provided on an outer side of the adjustment component.

8 Claims, 16 Drawing Sheets

DUMBBELL, BARBELL, AND KETTLEBELL

CROSS-REFERENCE TO RELATED APPLICATIONS

This application claims priority to Chinese Patent Application No. 202420202246.6, filed on Jan. 29, 2024, which is hereby incorporated by reference in its entirety.

TECHNICAL FIELD

The present disclosure relates to the field of fitness equipment technologies, and in particular, to a simple dumbbell, barbell, and kettlebell.

BACKGROUND

Dumbbells, barbells, and kettlebells are auxiliary equipment for weightlifting and fitness exercises, which are loved by fitness enthusiasts due to a small space occupation and convenient use. At present, dumbbells, barbells, and kettlebells on the market can be divided into two types: fixed weight and adjustable weight. The weight adjustable dumbbells, barbells, and kettlebells have better applicability because they can adjust the weight to meet the needs of different training intensities. Nowadays, most adjustable weight dumbbells on the market have complex structures and high production costs. To solve the above problems, the present disclosure provides a simple weight adjustable dumbbell, barbell, and kettlebell.

SUMMARY

A main purpose of the present disclosure is to provide a simple dumbbell, barbell, and kettlebell to solve the problem of complex structure and high production cost of most adjustable weight dumbbells, barbells, and kettlebells on the market.

In order to achieve the above objectives, the present disclosure provides the following scheme.

A simple dumbbell includes a dumbbell rod, an adjustment component, and a dumbbell piece,

- two semicircular telescopic rods are provided in the dumbbell rod, a square groove is respectively provided in a middle of the two semicircular telescopic rods; a square rod is provided on the square groove, a fix hole is respectively provided at two ends of the square rod that are in opposite directions; the two semicircular telescopic rods are provided with a limit tooth, respectively;
- the adjustment component includes an adjustment arm and a locking component, a middle of the adjustment arm is provided with a connection hole, a connection component connecting to an installation seat is provided in the connection hole, an adjustment area is provided below the adjustment arm, the adjustment area cooperates with the locking component to adjust the semicircular telescopic rod that passes through the adjustment component;
- the dumbbell piece is provided on an outer side of the adjustment component, the dumbbell piece is provided with a connection groove to connect to the semicircular telescopic rods.

In an embodiment of the present disclosure, a locking piece is provided in the locking component, a first bend is provided near a middle of the locking piece; one side of a right area of the first bent cooperates with the adjustment area, a left area thereof is provided with a semicircular hole corresponding to the semicircular telescopic rod; a convex tooth corresponding to the square groove is provided in the semicircular hole.

In an embodiment of the present disclosure, a first limit groove is provided at an end of the left area of the locking piece, the first limit groove is vertically embedded with a second limit groove on a first positioning piece; the first positioning piece is threaded to a fixing piece, the fixing piece is threaded to the installation seat; the first positioning piece is clamped by two locking pieces on an upper and a lower, the second limit groove is in a shape of trapezoid.

In an embodiment of the present disclosure, the other side of the right area of the locking piece is provided with a support column, a spring is provided on the support column; the spring passes through the second positioning piece and contacts a cover shell of the installation seat at an inner side.

In an embodiment of the present disclosure, the second positioning piece is threaded to a fix hole, the second positioning piece is clamped to a slot on a tail end of the dumbbell rod, the second positioning piece is provided at an installation hole of the installation seat.

In an embodiment of the present disclosure, a cover plate is provided on an outer side of the installation seat, the cover plate is threaded to the cover shell.

In an embodiment of the present disclosure, a connection recess is provided on the cover plate, the connection recess is inserted into a connection column on the dumbbell piece, and a handle is provided on the dumbbell piece.

In an embodiment of the present disclosure, an end of the semicircular telescopic rod is provided with a fix buckle.

In an embodiment of the present disclosure, a length of the dumbbell rod is increased to becomes a barbell rod and is configured to be the barbell.

In an embodiment of the present disclosure, a half component of the dumbbell is retained, the dumbbell rod and square rod are removed; an arc-shaped handle is provided on the cover shell to form a kettlebell, and a fixed disc is provided at a bottom of the kettlebell.

The present disclosure provides a simple dumbbell, barbell, and kettlebell with beneficial effect:

- the adjustment arm releases a lock of the semicircular telescopic rod, the semicircular telescopic rod can be pulled out from the fix buckle and directly removed or added dumbbell pieces or corresponding barbell pieces, which is simple and convenient.

BRIEF DESCRIPTION OF DRAWINGS

The drawings of the specification, which form a part of the present application, are intended to provide a further understanding of the present disclosure. It is obvious that the drawings described below are only some embodiments of the present disclosure. For those skilled in the art, other drawings can be obtained based on these drawings without creative work.

DESCRIPTION OF EMBODIMENTS

Figure 1:
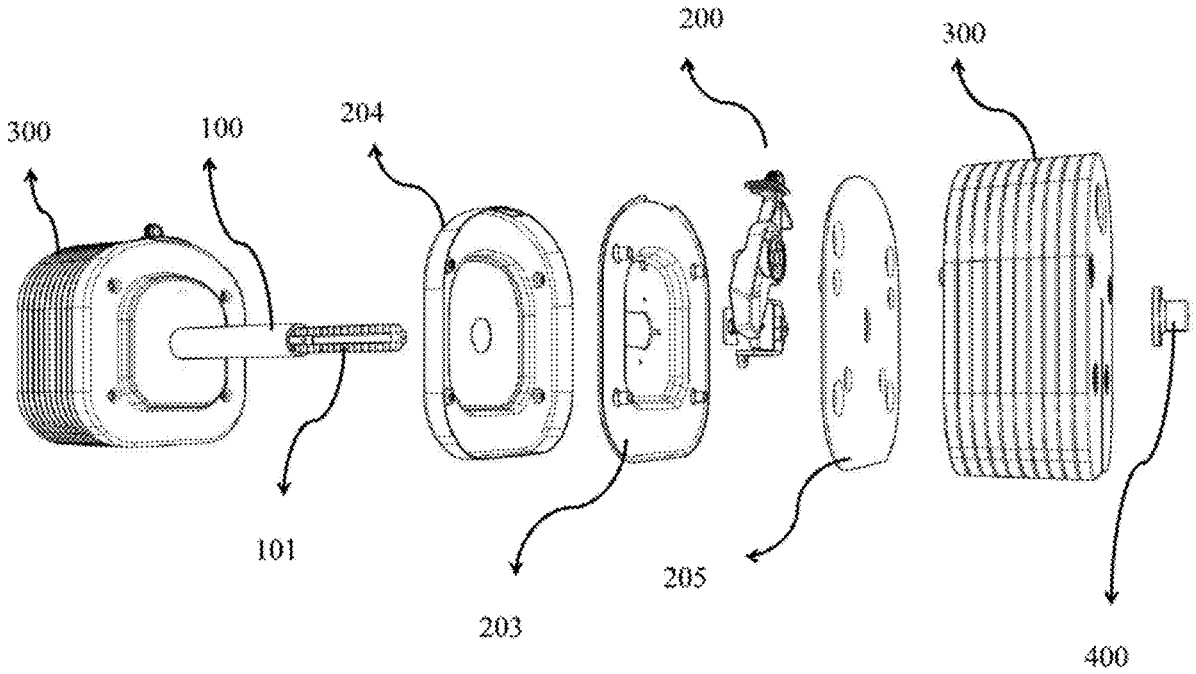
FIG. 1 is a schematic diagram of an overall decomposition of a dumbbell of the present disclosure.
Figure 2:
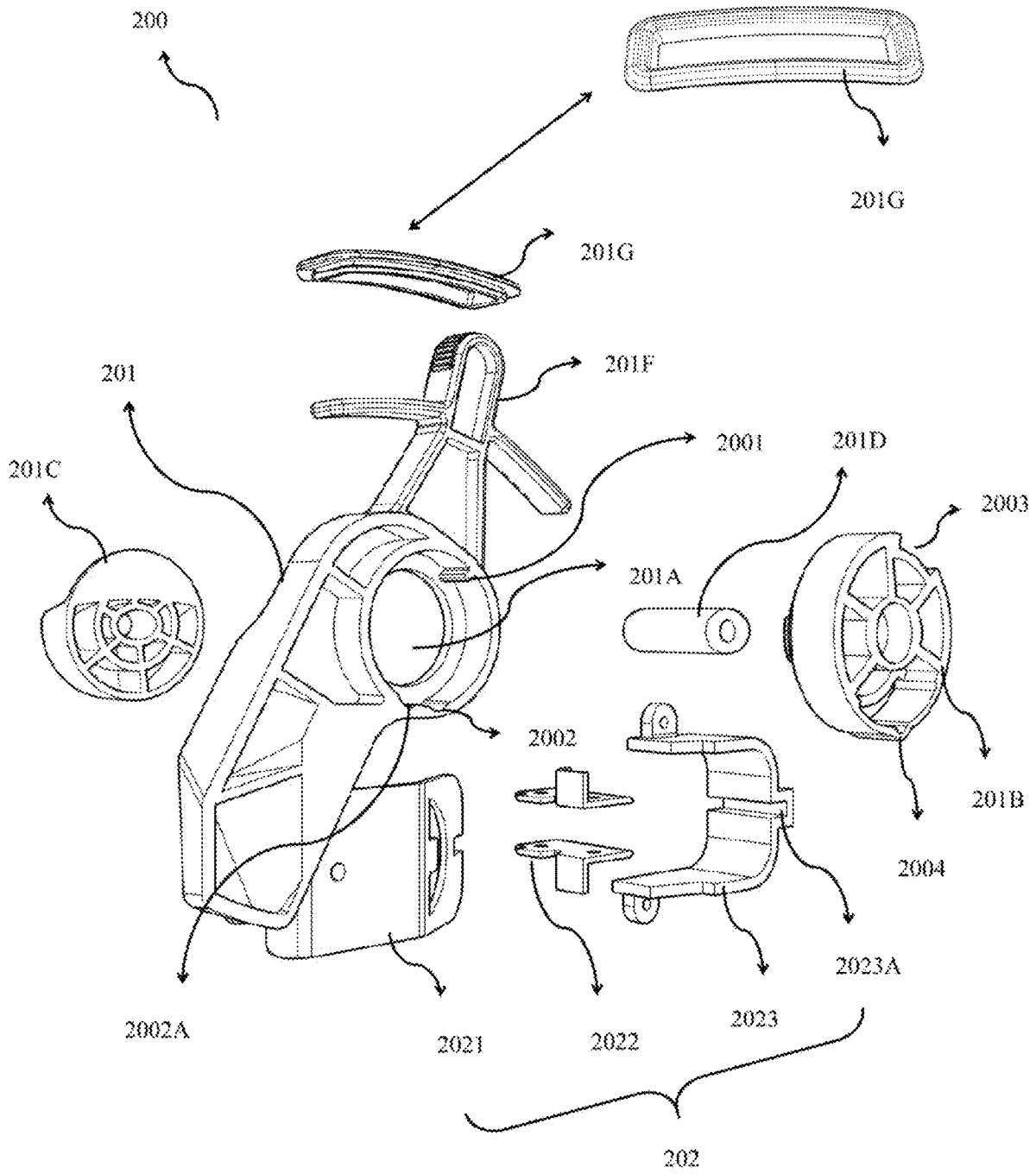
FIG. 2 is a schematic diagram of a decomposition of a locking component of the dumbbell of the present disclosure.

In the description of the present application, it should be noted that terms "center", "up", "down", "left", "right", "vertical", "horizontal", "inside", "outside", etc. indicate that an orientation or position relationship based on the orientation or position relationship shown in the drawings is only for a convenience of describing the present application and simplifying the description, and not to indicate or imply that the device or component referred to must have a specific orientation constructed and operated in a specific orientation, therefore cannot be understood as a limitation on the present application. In addition, terms "first" and "second" are only used to describe the purpose and cannot be understood as indicating or implying relative importance.

In the description of the present disclosure, it should be noted that unless otherwise specified and limited, terms "installation", "connection to", and "connection with" should be understood broadly. For ordinary technical personnel in this field, the specific meanings of the above terms in the present disclosure can be understood based on a specific circumstance.

The following will provide a clear and complete description of the technical solution in the embodiments of the present disclosure, in combination with the drawings. Obviously, the described embodiments are only a part of the embodiments of the present disclosure, not all of them. Based on the embodiments in the present disclosure, all other embodiments obtained by ordinary technical personnel in this field without creative work fall within the protection scope of the present disclosure.

As shown in FIGS. 1-10, in an embodiment of the present disclosure, a simple dumbbell is disclosed, including a dumbbell rod 100, an adjustment component 200, and a dumbbell piece 300. Two semicircular telescopic rods 101 are provided in the dumbbell rod 100, a square groove 103 is respectively provided in a middle of the two semicircular telescopic rods 101. A square rod 104 is provided on the square groove 103, a fix hole 106 is respectively provided at two ends of the square rod 104 that are in opposite directions. A limit tooth 102 is provided on the semicircular telescopic rod 101. The adjustment component 200 includes an adjustment arm 201 and a locking component 202. A connection hole 201A is provided in a middle of the adjustment arm 201, a connection component is provided in the connection hole 201A to connect with an installation seat 203. At the same time, an adjustment area 201E is provided below the adjustment arm 201, the adjustment area 201E cooperates with the locking component 202 to adjust the semicircular telescopic rod 101 that passes through the adjustment component 202. The dumbbell piece 300 is provide at an outer side of the adjustment component 200, a connection groove 302 is provided on the dumbbell piece 300 that is connected to the semicircular telescopic rod 101.

In an embodiment, when the dumbbell rod 100 is a hollow iron pipe or steel pipe, which is provided with two reverse installed semicircular telescopic rods 101 inside. At the same time, the semicircular telescopic rods 101 are respectively provided with a limit tooth 102, and the limit tooth 102 tilt backwards for easy movement after being unlocked.

A square groove 103 is provided in a central axis of the semicircular telescopic rod 101, rear walls at two ends of the square groove 103 are lower than front walls. Within the square groove 103, a square rod 104 is provided, and a fix hole 106 is respectively provided at two ends of the square rod 104 that are in opposite directions. When the square rod 104 moves, a left part of it is located on the rear wall, which can prevent the two semicircular telescopic rods 101 from rotating and misaligning when moving in a straight line.

A top of the adjustment arm 201 in the adjustment component 200 is provided with an adjustment handle 201F, a middle of which is provided with a connection hole 201A, a connection component is provided in the connection hole 201A, the connection component includes a connection buckle 201C and a connection shaft 201B. An elliptical bolt 201D connects the two (connection buckle 201C and a connection shaft 201B) and inserts them into the elliptical hole 203B on the installation seat 203, and the two are fixed by a bolt, so that the connection component becomes a rotation shaft of the adjustment arm 201. In order to prevent the adjustment arm 201 from rotating too much, a limit rib 2001 is provide on an inner side above the connection hole 201A, and corresponding, a movable groove 2003 is provided above the connection shaft 201B. A motion range of the limit rib 2001 in the movable groove 2003 is a motion range of the adjustment arm 201.

In an embodiment, a protrusion 2004 is downwardly provided at a bottom of an outer side of the connection shaft 201B, and correspondingly, a first groove 2002 and a second groove 2002A are provided below an inner side of the connection hole 201A. When the protrusion 2004 moves to the two grooves and to lock the protrusion, and it can be unlocked by forcefully pushing the adjustment handle 201F.

In an embodiment, as shown in FIGS. 2-6, a lower part of the adjustment arm 201 is the adjustment area 201E, a top of the adjustment area 201E is provided with an inclined surface that is matched with a locking piece 2021 in the locking component. A first bend 2021A is provided near a middle area of the locking piece 2021, a front of a right area is matched with the adjustment area 201E.

A second bend 2021F is provided at a tail end of the right area of the locking piece 2021 to reduce wear between the locking piece 2021 and the adjustment area 201E.

Figure 16:
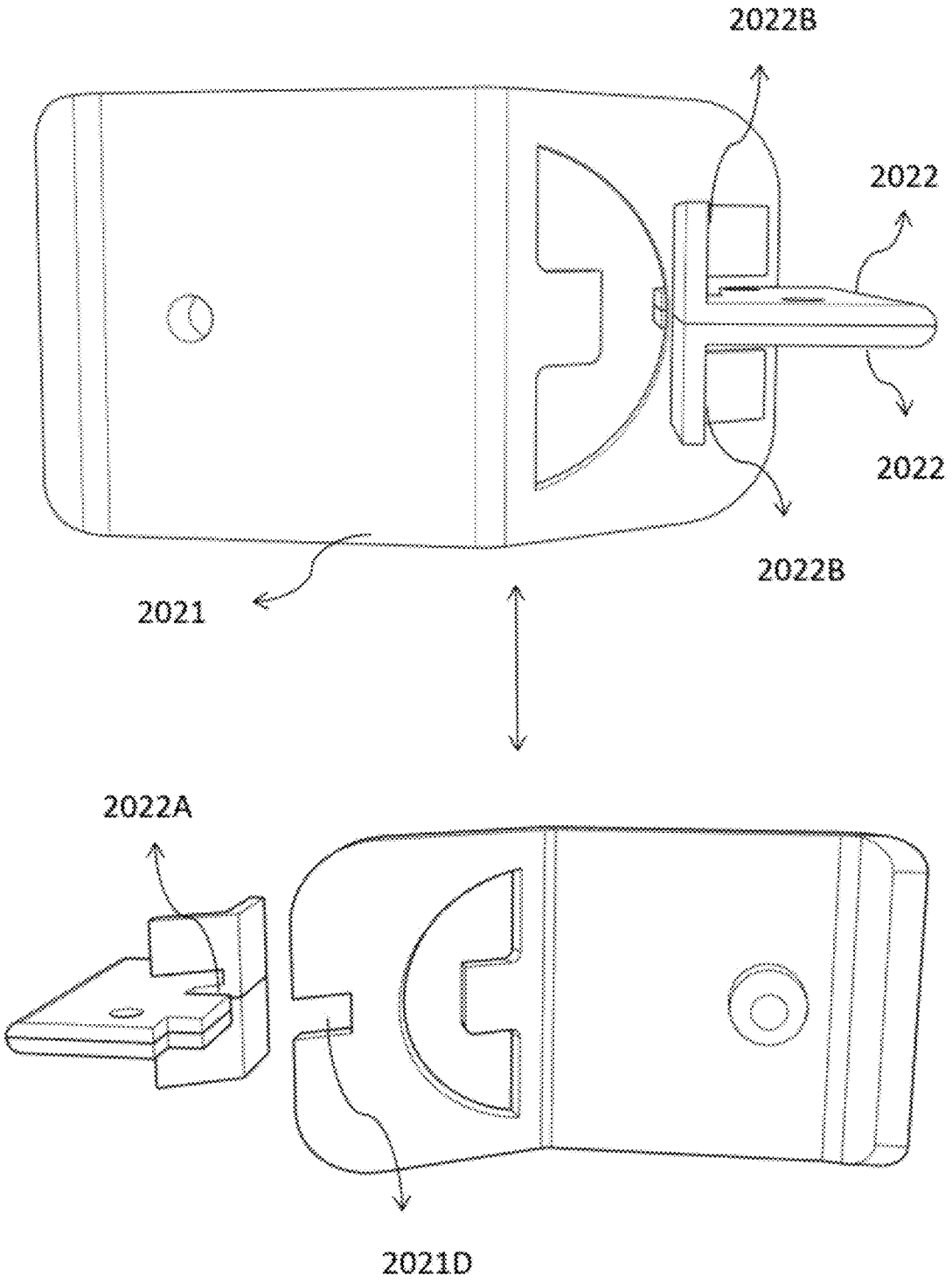
FIG. 16 is a schematic diagram showing a first limit groove being embedded with a second limit groove of the present disclosure.

At the same time, a semicircular hole 2021B corresponding to the semicircular telescopic rod 101 is provided at a left area of the locking piece 2021. In the semicircular hole 2021B, a convex tooth 2021C is provided corresponding to the square groove 103. When the semicircular telescopic rod 101 passes through the semicircular hole 2021B, two sides of the convex tooth 2021C fall into a spacing between the limit teeth 102, and thereby locking the semicircular telescopic rod 101. At the same time, the convex tooth 2021C falls into the square groove 103 to limit the semicircular telescopic rod and prevent it to be falling from In an implementation mode, as shown in FIG. 16, a first limit groove 2021D provided at an end of a left area of the locking piece 2021 and a second limit groove 2022A on a first positioning piece 2022 are vertically embedded, the first positioning piece 2022 is provided with two upper and lower pieces. At the same time, a blocking piece 2022B is further provided on the positioning piece 2022 that is fixedly connected to the first positioning piece 2022, the blocking piece is tightly attached to a part of the left area of the locking piece 2021 to fix the left area of the locking piece 2021 from shifting outward.

The fixing piece 2023 is U-shaped, with a fix groove 2023A at a bottom. When in a flat state, tail ends of two first positioning pieces 2022 are inserted into the fix groove 2023A. At the same time, two screw holes are provided on the first positioning piece 2022 to connect with the fixing piece 2023 to fix the first positioning piece 2022. The fixing piece 2023 is threaded to the installation seat 203 to fix it.

The second limit groove 2022A is in a shape of trapezoid and has an opening larger than the first limit groove 2021D, thereby leaving room for the locking piece 2021 to move.

Figure 3:
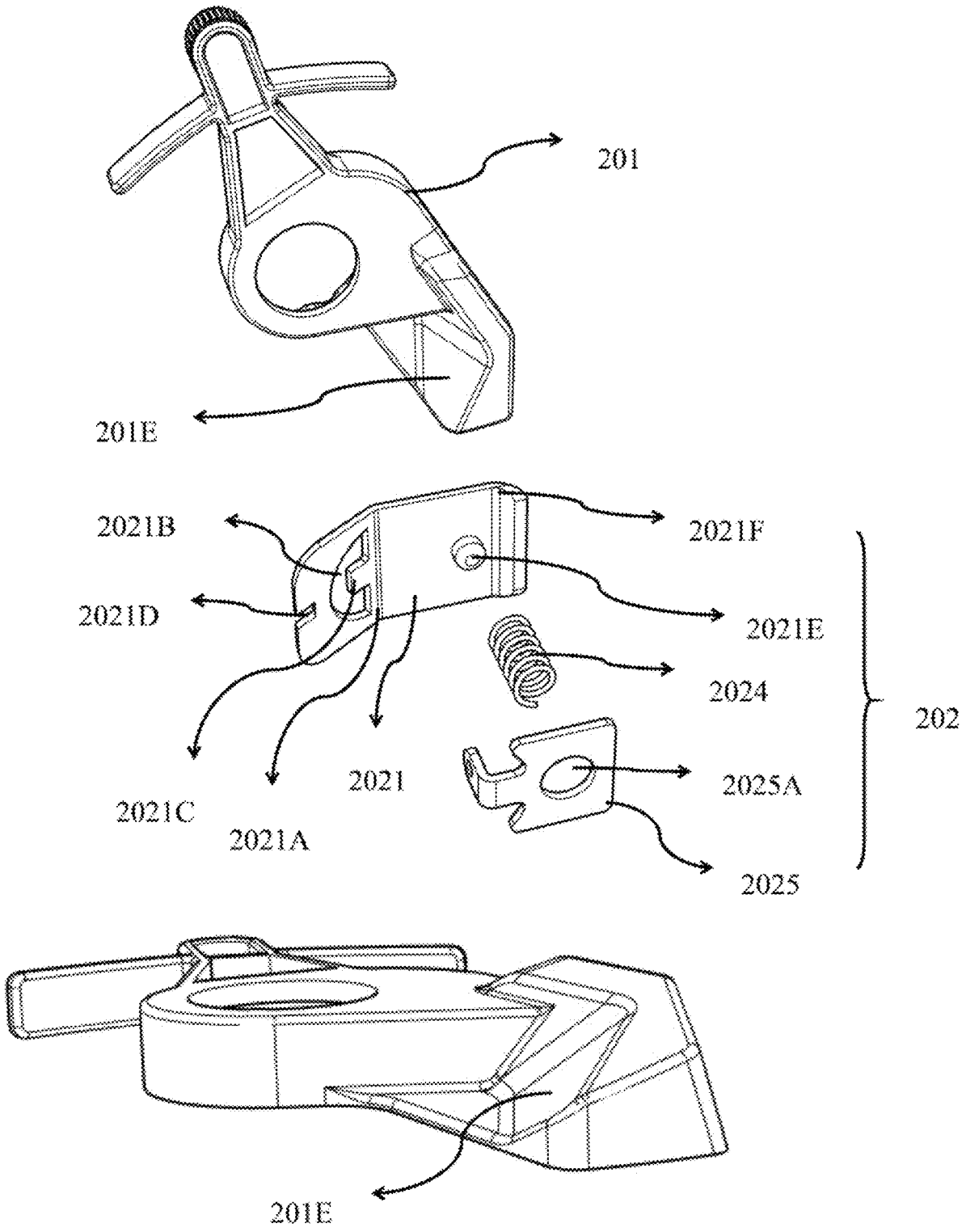
FIG. 3 is a schematic diagram of an adjustment arm of the dumbbell of the present disclosure.
Figure 4:
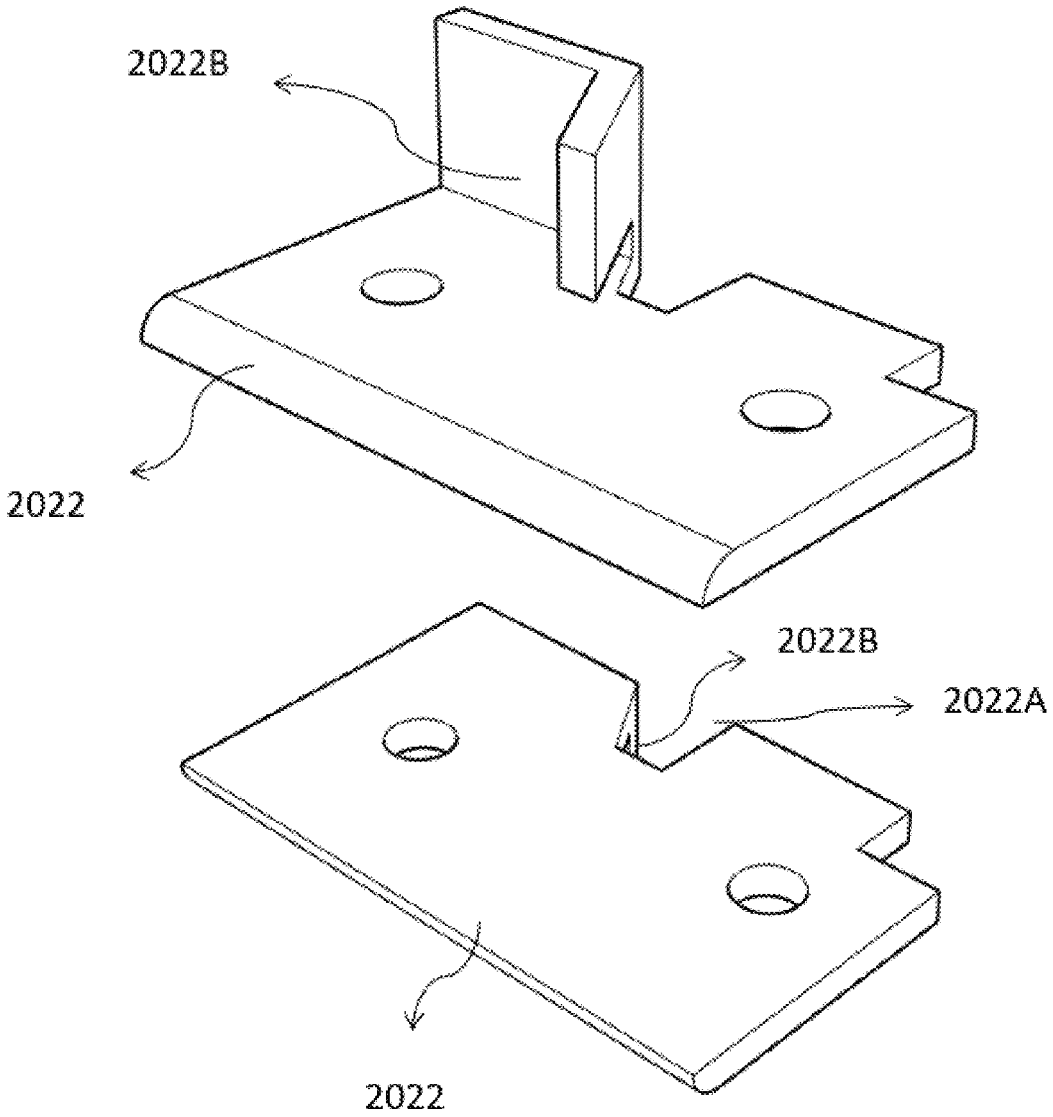
FIG. 4 is a schematic diagram of a first positioning component of the dumbbell of the present disclosure.
Figure 5:
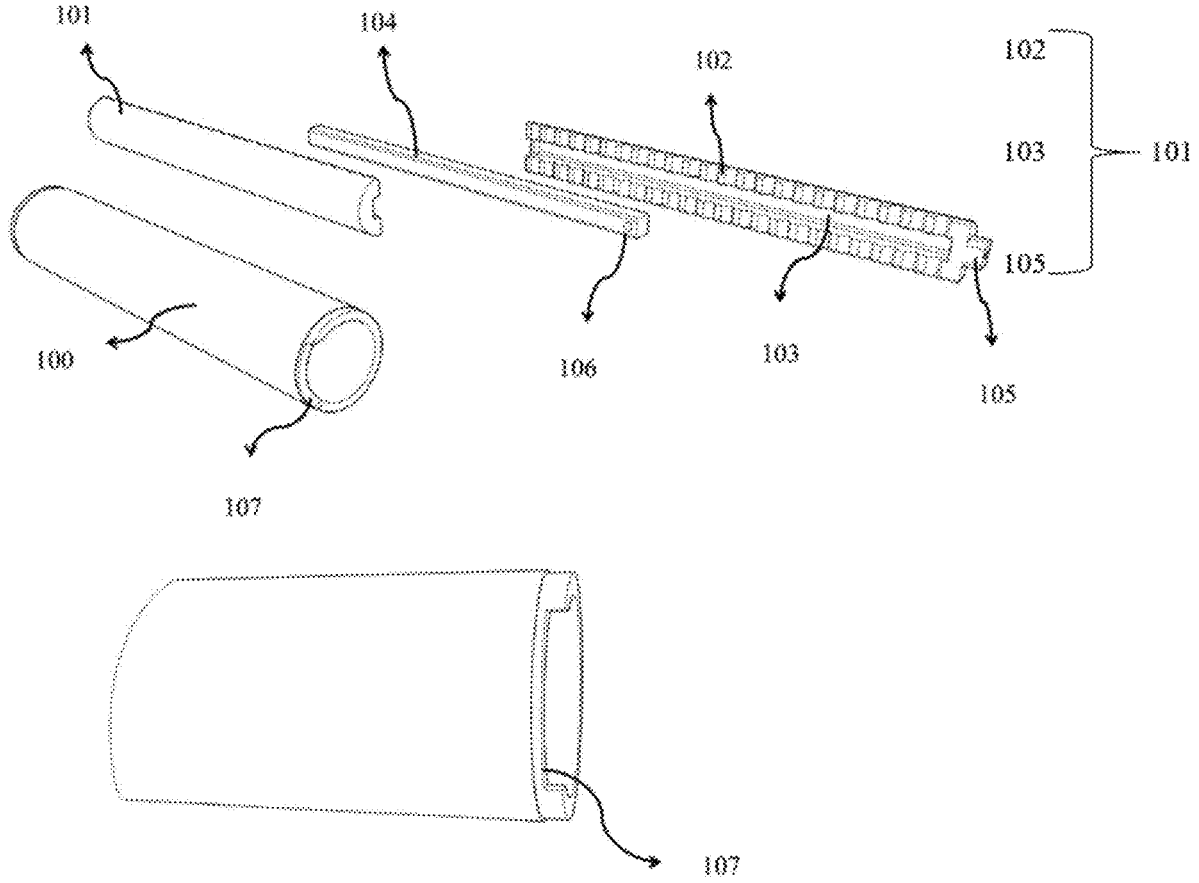
FIG. 5 is a schematic diagram of a decomposition of a dumbbell rod and a semicircular telescopic rod of the present disclosure.
Figure 6:
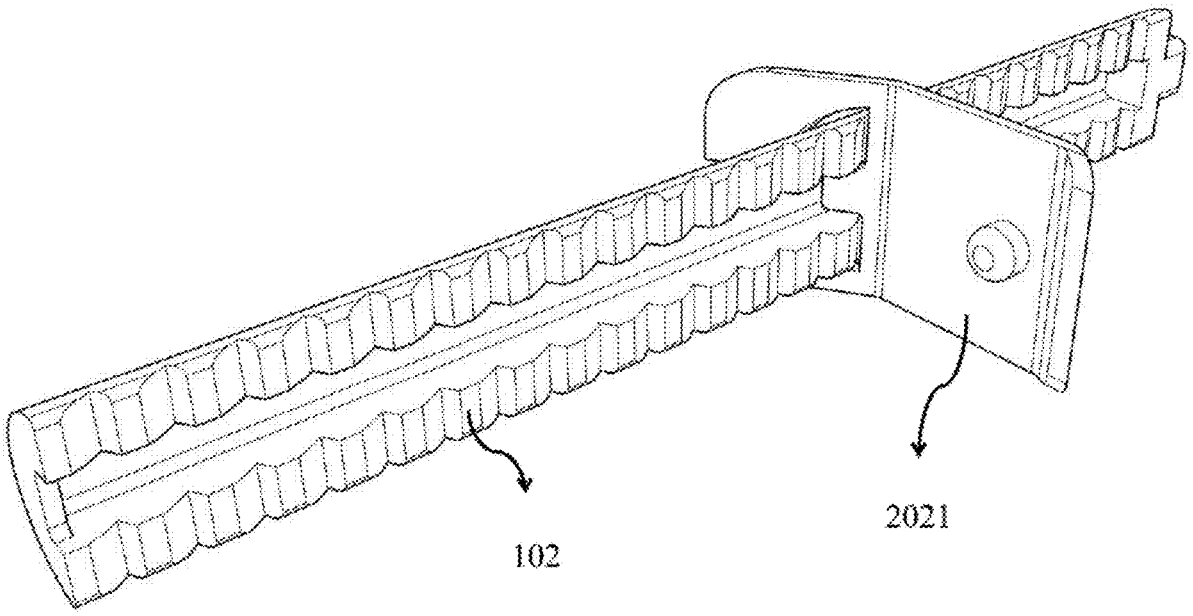
FIG. 6 is a schematic diagram of an assembly state of the semicircular telescopic rod and the locking component of the dumbbell of the present disclosure.

In an embodiment, as shown in FIGS. 3 and 5, a support column 2021E is provided behind the right area of the locking piece 2021, a spring 2024 connects with the support column 2021E, the spring 2024 passes through a circular hole 2025A of the second positioning piece 2025 and contacts a cover shell 204 on an inner side of the installation seat 203. The second positioning piece 2025 is threaded and connected to the fix hole 106 at an end of the square rod 104. At the same time, the second positioning piece 2025 is also clamp connection to a slot 107 at an end of the dumbbell rod to prevent rotation.

Figure 8:
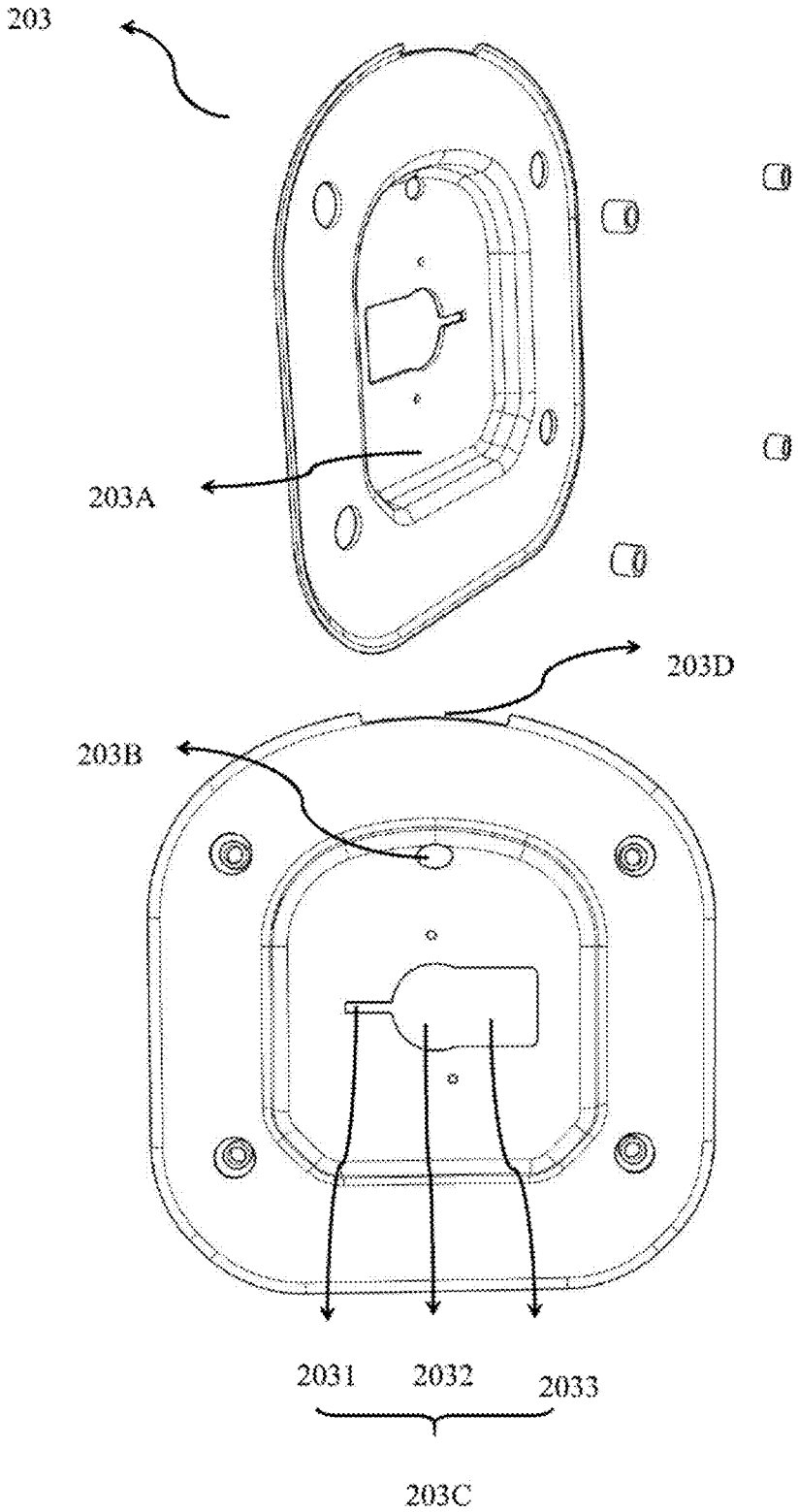
FIG. 8 is a schematic diagram of an installation seat of the dumbbell of the present disclosure.
Figure 9:
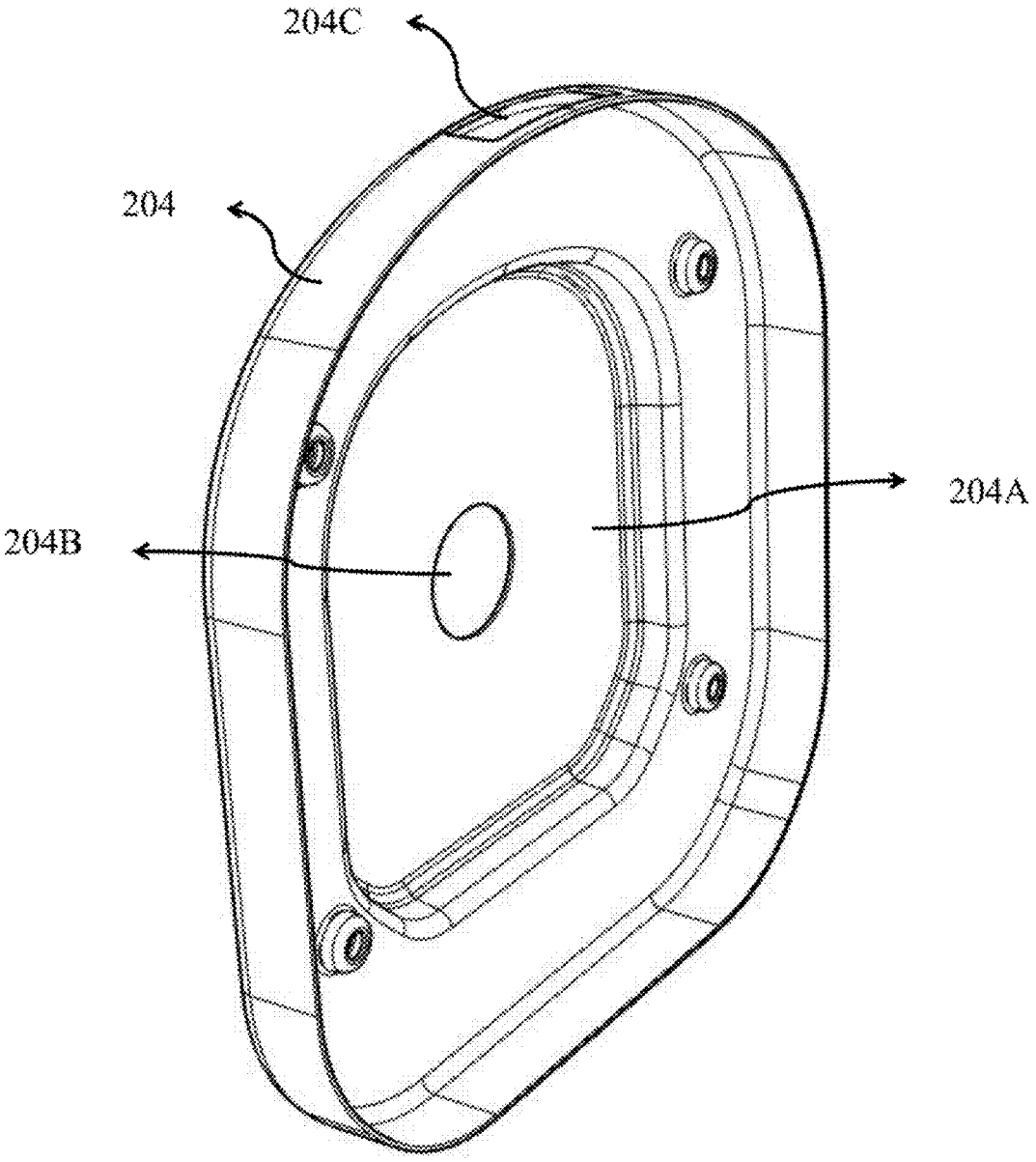
FIG. 9 is a schematic diagram of a fix buckle of the dumbbell of the present disclosure.
Figure 10:
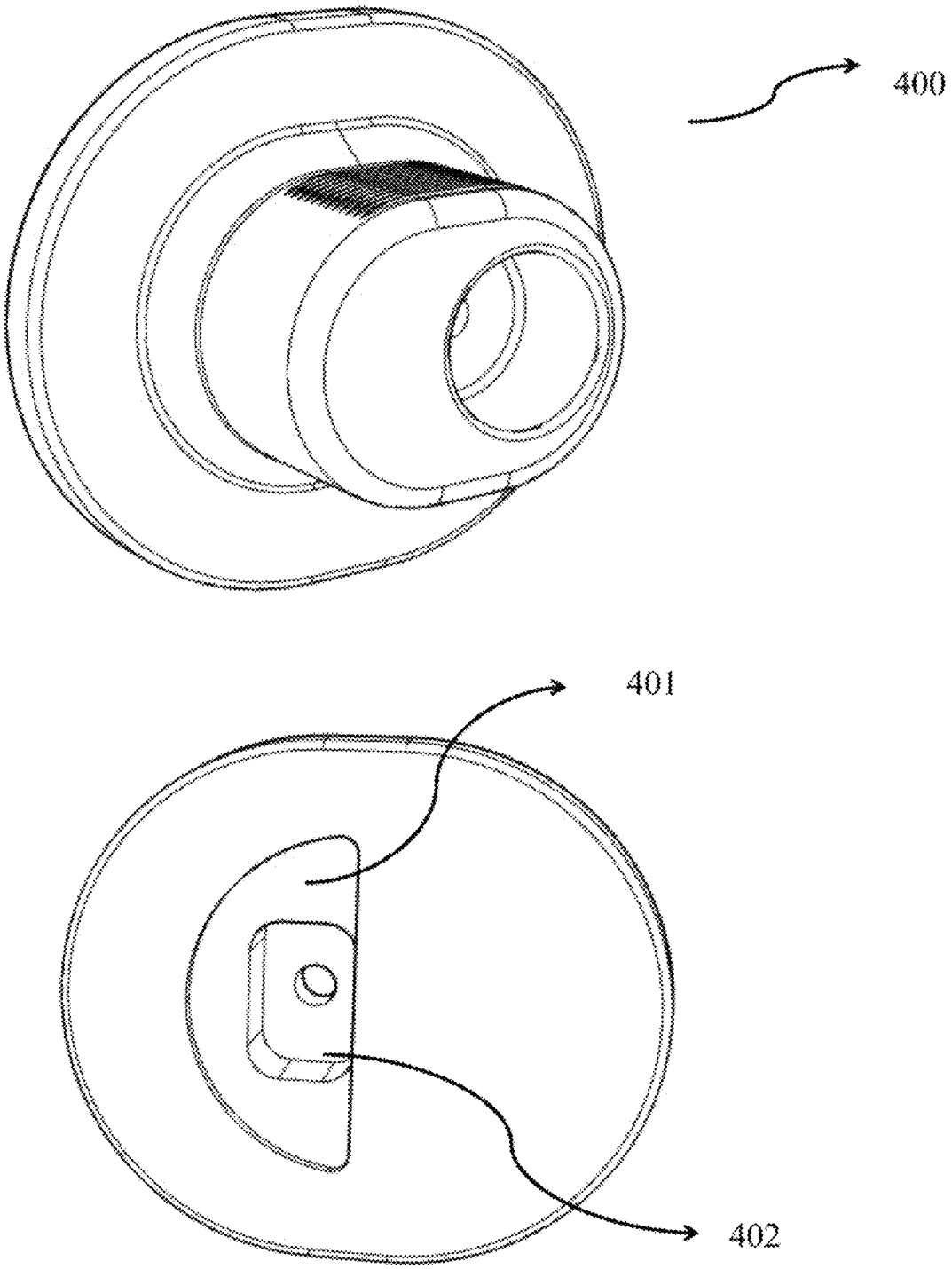
FIG. 10 is a schematic diagram of a cover shell of the dumbbell of the present disclosure.

As shown in FIGS. 8-9, a first installation chamber 203A is provided in a middle of the installation seat 203, the adjustment component 200 is located therein. At the same time, an installation hole 203C is provided in a middle of the first installation chamber 203A, an arc-shaped area 2032 is sleeved on the tail end of the dumbbell rod, one end of the first positioning piece 2022 is located in a long-slot-shaped hole area 2031, the second positioning piece 2025 is located in a square hole area 2033. At the same time, a second installation chamber 204A is provided in a middle area of the cover shell 204, and a circular hole 204B is provided in a middle of the cover shell. The first installation chamber 203A is sleeved into the second installation chamber 204A, and both are threaded and installed at the end of the dumbbell rod, forming mutual restraint and fixation of various components.

In addition, a clearance groove 203D is formed at a top of the installation seat 203, an adjustment handle groove 204C is provided at a top of the corresponding cover shell 204, both of which are configured to install the adjustment handle 201F. During assembly, a decorative cover 201G is covered at the adjustment handle groove, which renders it looks more beautiful.

Figure 7:
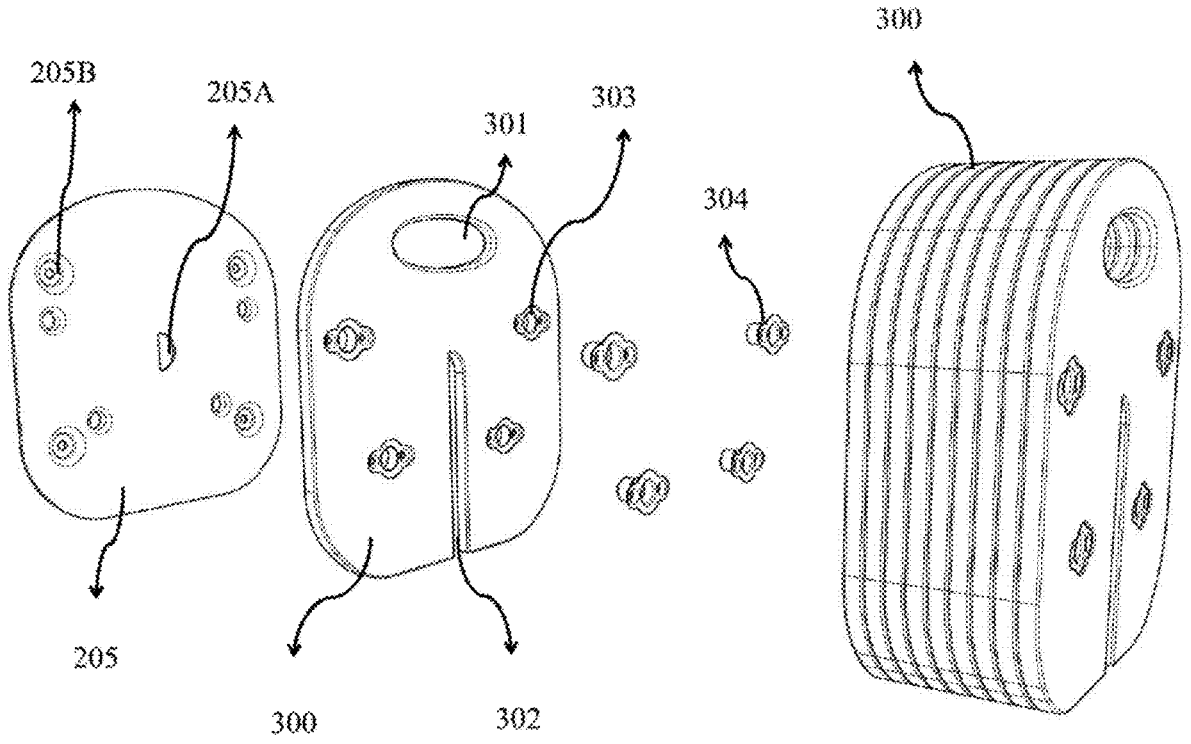
FIG. 7 is a schematic diagram of a decomposition of the dumbbell piece of the present disclosure.

In an embodiment, as shown in FIGS. 1 and 7, a cover plate 205 is provided on an outer side of the installation seat 203, which is threaded to the cover shell 204. A semicircular installation hole 205A is provided in a middle of the cover plate 205 to facilitate the semicircular telescopic rod to pass through. At the same time, multiple connection recesses 205B are further provided on the cover plate 205. At the same time, a connection column hole 303 is provided on the dumbbell piece 300 to be threaded to the dumbbell piece 300, the connection column 304 is hollow, a front diameter of the connection column 304 is smaller than a rear diameter thereof, so that multiple dumbbell pieces 300 can be inserted together through the connection column 304.

In an implementation mode, a handle 301 is provided on a top of the dumbbell piece 300, a connection groove 302 is provided below the dumbbell piece to facilitate the placement and retrieval of the dumbbell piece.

In an implementation mode, the semicircular telescopic rod 101 passes through the connection groove 302 and is provided with a square connection pin 105 at its end, a threaded fix buckle 400 is provided on the connection pin 105. The fix buckle is provided with a semicircular inner groove 401 that matches the semicircular telescopic rod. In the semicircular inner groove 401, a square inner groove 402 is further provided on the square connection pin 105 and fixed with a screw, rendering it convenient to push and pull the semicircular telescopic rod 101 by hand.

The structures of the components on two sides of the dumbbell rod are the same, and the operation of removing dumbbell pieces thereof are also the same.

Figure 11:
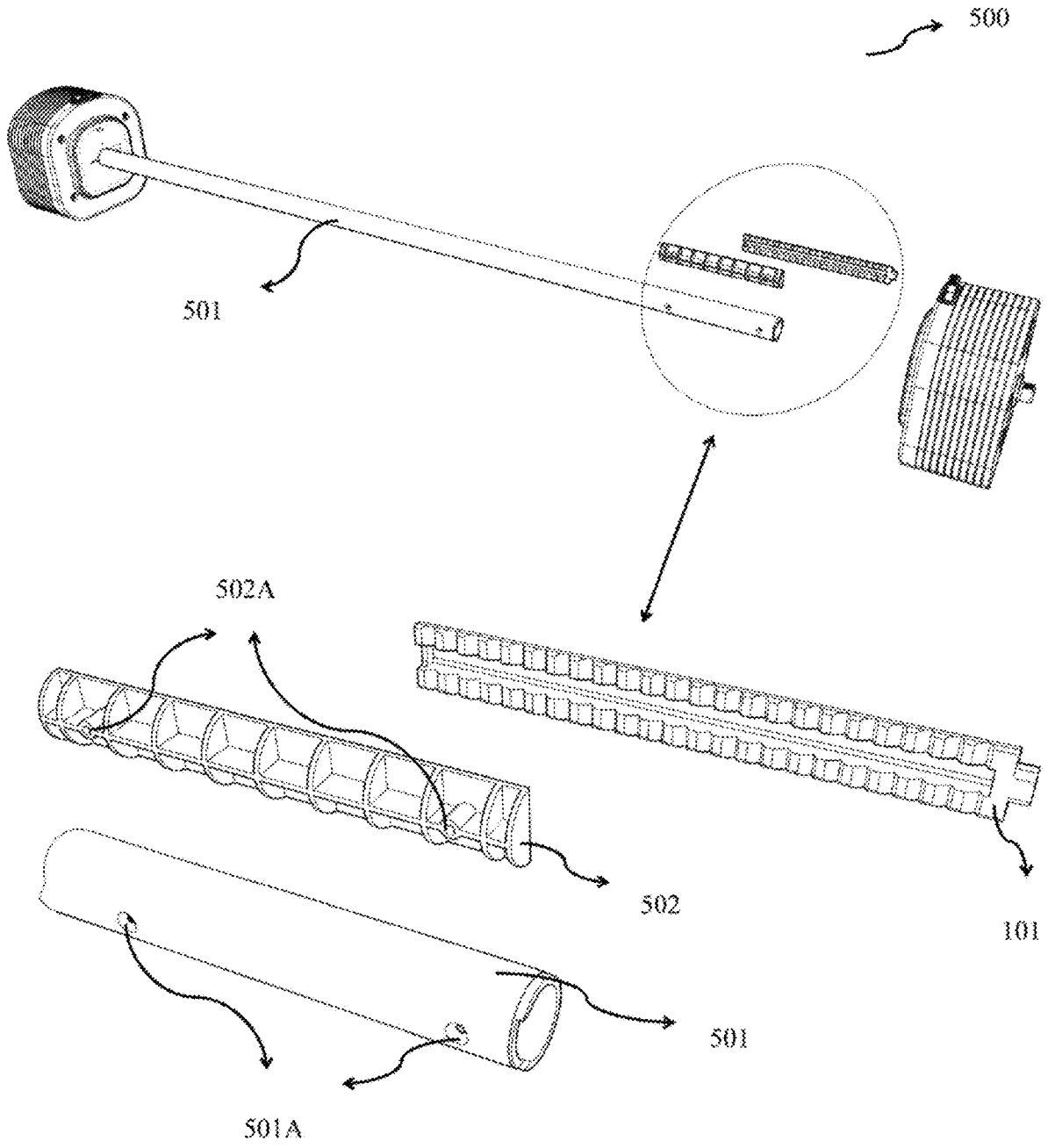
FIG. 11 is a schematic diagram of a decomposition of the barbell and a tail end of the barbell rod of the present disclosure.
Figure 12:
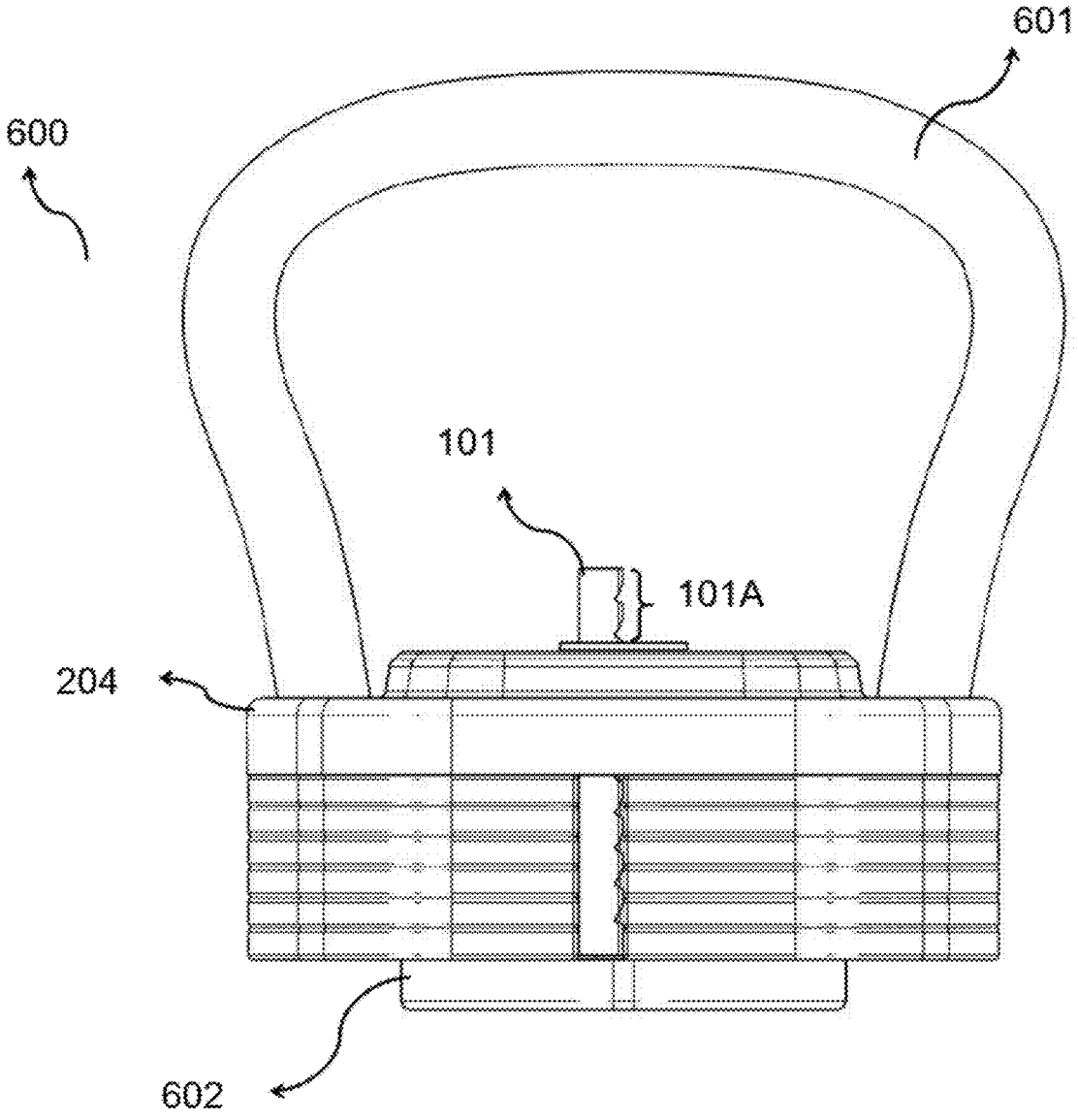
FIG. 12 is a side schematic diagram of a kettle bell of the present disclosure.
Figure 13:
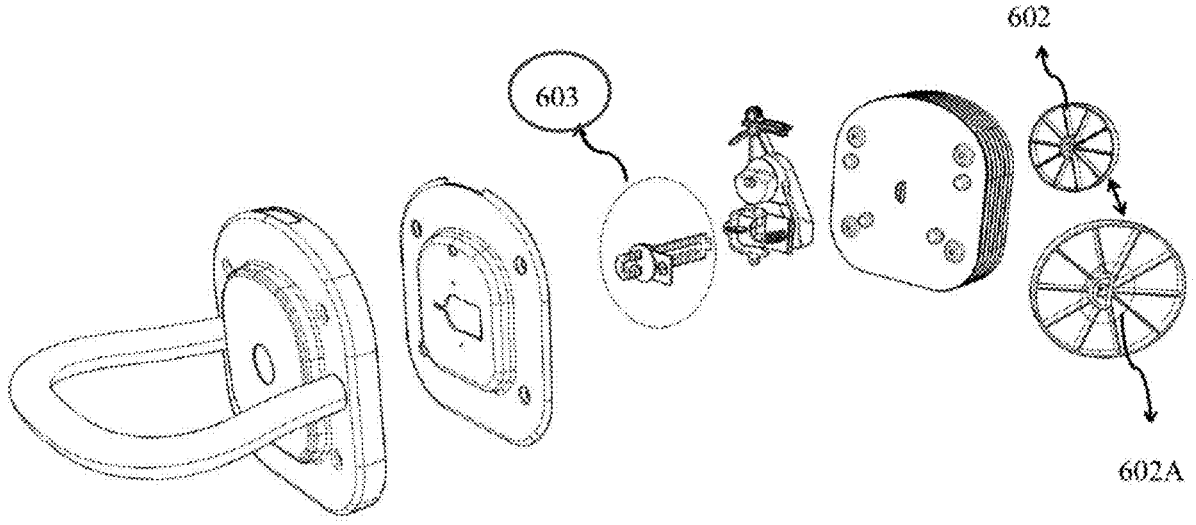
FIG. 13 is a schematic diagram of a decomposition of the kettle bell in the present disclosure.
Figure 14:
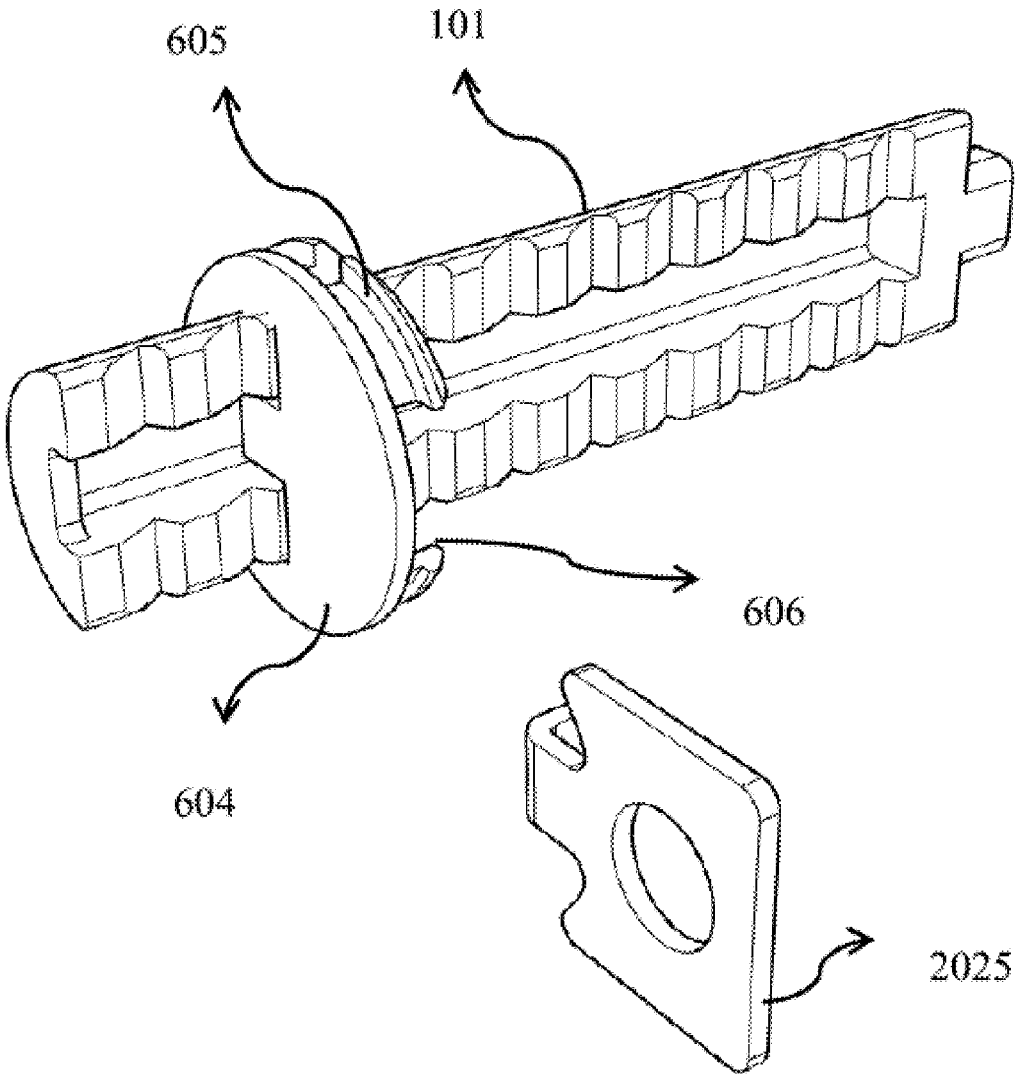
FIG. 14 is a schematic diagram of an assembly of a locking buckle and semicircular telescopic rod of the kettle bell in the present disclosure.
Figure 15:
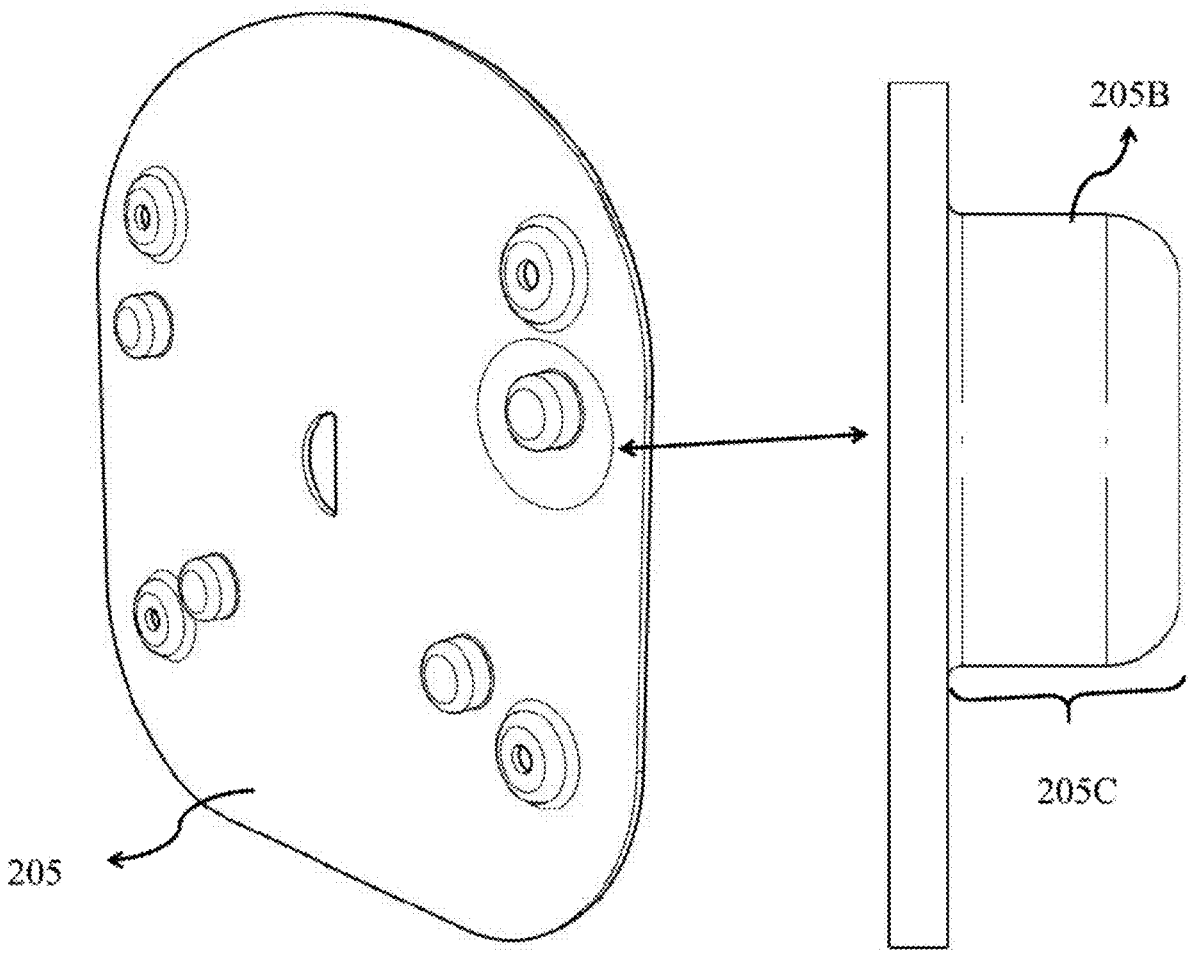
FIG. 15 is a schematic diagram of a distance between a cover plate and a connection recess of the kettle bell in the present disclosure.

In an embodiment, as shown in FIG. 11, the dumbbell rod 100 can be extended to use as a barbell rod 501. The structure of each component on two sides of the barbell rod 501 is the same as that of the dumbbell. A half cylinder 502 with a same size as the semicircular telescopic rod 101 is respectively provided at two ends of the barbell rod 501. Compared to the dumbbell, there is no square rod in the square groove of the barbell 500, a first threaded hole 502A is provided on the half cylinder 502. At the same time, a corresponding second threaded hole 501A is provided at a tail end of the barbell rod 501, and the two are connected and fixed by a bolt, which can fill the space of the semicircular telescopic rod 101 in the barbell rod 501 and prevent it from loosening and misalignment when moving in a straight line.

In an embodiment, as shown in FIGS. 12-15, a half of the components are retained on the basis of the dumbbell, and the dumbbell rod and square rod are removed. At the same time, an arc-shaped handle 601 is fixedly provided on an outer side of the cover shell 204, which can be used as the kettle bell 600. The semicircular telescopic rod 101 is extended outward near an end of the cover shell 204 to form an avoidance area 101A, a length of the avoidance area 101A is slightly larger than a protruding section 205C of the connection recess 205B. In this way, there is enough space on the semicircular telescopic rod to take out the dumbbell pieces.

In an implementation mode, a locking buckle 604 is provided at the circular hole 204B of the cover shell 204, with a middle convex tooth falling into a square groove to prevent the locking buckle from rotating. However, it does not constrain the limit tooth on the semicircular telescopic rod, and a buckle 605 is provided on the locking buckle 604. At the same time, a snap port 606 is provided on a buckle ring 605 for clamping the second positioning piece 2025. The locking buckle 604 is simultaneously clamped at the circular hole 204B and a circular arc area 2032 of the installation hole 203C for fixation.

In an implementation mode, a fixed disc 602 is installed at a tail end of the semicircular telescopic rod, a connection area 602A in a middle of the fixed disc has the same structure as the semicircular inner groove and square groove on the fix buckle of the dumbbell, the connection method is also the same.

The working principle of dumbbells is that the adjustment handle 201F is moved to the protrusion 2004 and slide into the first groove 2002. An adjustment area 201E under the adjustment arm 201 squeezes the right area of the locking piece 2021, two sides of the convex teeth exit the spacing between the limit teeth. At this time, the semicircular telescopic rod 101 is unlocked, the semicircular telescopic rod can be pulled out of the dumbbell rod 100 by hand at the fix buckle 400. At this time, the dumbbell piece can be placed and removed. Afterwards, the semicircular telescopic rod 101 can be pushed into the dumbbell rod 100 until the fix buckle 400 clamps tightly the dumbbell piece 300, and the adjustment handle 201F can be pushed back to the protrusion 2004 and locked in the second groove 2002A. At the same time, both sides of the convex teeth fall into a spacing between the limit teeth to lock the semicircular telescopic rod. The locking piece 2021 is pushed back to its original position by the spring, and the operation is completed.

The working principle of barbells and kettlebells is the same as that of dumbbells and will not be elaborated further.

Although the present application has been described in detail with reference to the aforementioned embodiments, ordinary technical personnel in the art should understand that they can still modify the technical solutions recorded in the aforementioned embodiments, or equivalently replace some of the technical features therein; and these modifications or replacements do not make the essence of the corresponding technical solutions deviate from the scope of the technical solutions of the various embodiments of the present application.

What is claimed is:

1. A simple dumbbell, comprising a dumbbell rod, an adjustment component, and a dumbbell piece, two semicircular telescopic rods are provided in the dumbbell rod, a square groove is respectively provided in a middle of each of the two semicircular telescopic rods; a square rod is provided on the two square grooves, a fix hole is respectively provided at two ends of the square rod, wherein the two ends of the square rod extend in opposite directions; the two semicircular telescopic rods are each provided with a limit tooth, respectively;

the adjustment component comprises an adjustment arm and a locking component, a middle of the adjustment arm is provided with a connection hole, a connection component connecting to an installation seat is provided in the connection hole, an adjustment area is provided below the adjustment arm, the adjustment area cooperates with the locking component to adjust the two semicircular telescopic rods that pass through the adjustment component;

the dumbbell piece is provided on an outer side of the adjustment component, the dumbbell piece is provided with a connection groove to connect to a respective semicircular telescopic rod of the two semicircular telescopic rods;

wherein the locking component comprises a locking piece with a first bend, a semicircular hole, a convex tooth, a first limit groove, a support column, a second bend, two first positioning pieces, a fixing piece, a spring, and a second positioning piece;

wherein the connection component comprises a connection buckle and a connection shaft;

wherein each of the two first positioning pieces comprises a second limit groove and a blocking piece;

wherein the fixing piece is U-shaped, with a fix groove at a bottom thereof;

wherein the second positioning piece comprises a circular hole and is connected to the fix hole at one end of the square rod.

2. The simple dumbbell according to claim 1, wherein the locking piece is provided in the locking component, the first bend is provided near a middle of the locking piece; one side of a right area of the locking piece cooperates with the adjustment area, a left area of the locking piece is provided with the semicircular hole corresponding to a respective semicircular telescopic rod of the two semicircular telescopic rods; the convex tooth corresponding to a respective one of the two square grooves is provided in the semicircular hole.

3. The simple dumbbell according to claim 2, wherein the first limit groove is provided at an end of the left area of the locking piece, the first limit groove is embedded with the second limit groove;

the two first positioning pieces are threaded to the fixing piece, and the fixing piece is threaded to the installation seat;

wherein the second limit groove is in a shape of trapezoid.

4. The simple dumbbell according to claim 2, wherein the other side of the right area of the locking piece is provided with the support column, the spring is provided on the support column; the spring passes through the second positioning piece and contacts a cover shell on an inner side of the installation seat.

5. The simple dumbbell according to claim 4, wherein the second positioning piece is clamped to a slot on a tail end of the dumbbell rod, the second positioning piece is provided at an installation hole of the installation seat.

6. The simple dumbbell according to claim 5, wherein a cover plate is provided on an outer side of the installation seat, wherein the cover plate is threaded to the cover shell.

7. The simple dumbbell according to claim 6, wherein a connection recess is provided on the cover plate, the connection recess is inserted into a connection column on the dumbbell piece, and a handle is provided on the dumbbell piece.

8. The simple dumbbell according to claim 1, wherein an end of a respective semicircular telescopic rod of the two semicircular telescopic rods is provided with a fix buckle.

* * * * *